US007533880B2

(12) United States Patent
Kawanishi et al.

(10) Patent No.: US 7,533,880 B2
(45) Date of Patent: May 19, 2009

(54) SHEET FEEDING DEVICE AND IMAGE FORMING APPARATUS

(75) Inventors: Minoru Kawanishi, Yokohama (JP); Akira Matsushima, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 321 days.

(21) Appl. No.: 11/531,876

(22) Filed: Sep. 14, 2006

(65) Prior Publication Data

US 2007/0069450 A1 Mar. 29, 2007

(30) Foreign Application Priority Data

Sep. 27, 2005 (JP) ..... 2005-279651

(51) Int. Cl.
*B65H 1/00* (2006.01)

(52) U.S. Cl. ..... 271/171

(58) Field of Classification Search ..... 271/171; 399/393

See application file for complete search history.

(56) References Cited

U.S. PATENT DOCUMENTS 6,669,188 B1 * 12/2003 Marasco et al. ..... 271/171

2006/0269349 A1 11/2006 Kawanishi et al. ..... 400/625

FOREIGN PATENT DOCUMENTS

JP 08-217260 8/1996

* cited by examiner

*Primary Examiner*—David H Bollinger
(74) *Attorney, Agent, or Firm*—Fitzpatrick, Cella, Harper & Scinto

(57) ABSTRACT

A sheet cassette, which can accommodate sheets of different sizes and can detachably attachable in a width direction orthogonal to a sheet conveyance direction, includes side guides for regulating the positions of the accommodated sheets in a width direction and a rear regulation guide for regulating an edge of a sheet in the width direction in the vicinity of the rear edge of the sheet on a back side of the sheet cassette in a mounting direction, and the rear regulation guide is swingably disposed and regulates a position of the sheet by swinging a plurality of regulating surfaces corresponding to the sheets of the different sizes and moving to regulating positions.

10 Claims, 13 Drawing Sheets

SHEET FEEDING DEVICE AND IMAGE FORMING APPARATUS

BACKGROUND OF THE INVENTION

1. Filed of the Invention

The present invention relates to a detachably attachable sheet cassette for accommodating sheets, and, more particularly, to a sheet feeding device for feeding sheets or to a sheet cassette used in an image forming apparatus such as a printer, a copying machine, a facsimile, and the like for forming an image on a sheet.

2. Description of the Related Art

Heretofore, image forming apparatuses are provided with a sheet cassette in detachably attachable manner in which sheets to be supplied for image formation are accommodated. As disclosed in Japanese Patent Application Laid-Open Publication No. 8-217260, the sheet cassette used by being mounted on the image forming apparatuses in detachably attachable manner includes a sheet cassette that can accommodate sheets of different sizes.

FIG. 11 exemplifies a sheet cassette 50 that can selectively accommodate A3 size sheets S1 and 11×17 inch size sheets S2. The sheet cassette 50 shown in FIG. 11 includes a pair of sheet width regulating plates 51, 52 for regulating the positions of the accommodated sheets S1 or S2 in a width direction. The sheet width regulating plates 51, 52 are disposed movably in the sheet width direction so that they are aligned with the side edges of accommodated sheets S1, S2. Further, the sheet cassette 50 includes a back guide 23 for regulating the positions of the rear edges of the sheets S1 or S2. The back guide 23 is disposed so as to move in a sheet feeding direction so that it is aligned with the rear edges of the accommodated sheets S1, S2.

Further, the sheet cassette 50 shown in FIG. 11 is arranged such that it can be drawn from and accommodated in an image forming apparatus body in a direction orthogonal to a sheet conveyance direction. The sheet cassette 50 arranged as described above is provided with ribs 53, 54 at positions corresponding to the A3 size sheets S1 and the 11×17 inch size sheets S2, respectively to prevent the rotation (positional non-alignment) of the rear edges of the sheets due to a shock when the sheet cassette is inserted.

Recently, image forming apparatuses capable of forming a color image become widespread, the size of sheets used by users becomes diversified. Specifically, a demand for sheet sizes wider than, for example, the A3 size described above is increased as the sizes of sheets to be used by the users, and thus the sheet cassette is required to support the sheets of these sizes. Note that, as the size wider than the A3 size, there is a sheet size called a full bleed sheet, for example, RA3 (305 mm×430 mm), 12×18 inches (304.8 mm×431.8 mm), SRA3 (320 mm×450 mm) and the like.

When a sheet having a size wider than the A3 size is supported, the number of ribs for preventing the rotation of the sheet described above must be increased to the number of the sizes of the sheets supported thereby. However, since sheets have different lengths in the conveyance direction and in the width direction depending on sizes, even if the sizes of the sheets to be supported are increased, the number of the rotation prevention ribs cannot be increased accordingly. Therefore, a problem arises in that even if the number of the sizes that can be accommodated in the sheet cassette is increased, sheets may be rotated when the sheet cassette is inserted depending on the sizes of the accommodated sheets. Then, when a sheet is fed out in this state, since skew feeding of the sheet occurs, an image is deteriorated by jam (clogging of sheet) and the non-alignment of the sheet from an image position.

SUMMARY OF THE INVENTION

Accordingly, an object of the present invention is to provide a sheet cassette which can prevent the rotation of all the sizes of sheets that can be accommodated when the sheet cassette is inserted.

To achieve the above object, a sheet feeding device of the present invention having a sheet cassette that can accommodate sheets of different sizes and can be detachably attachable to a device body and a sheet feeding portion which feeds the sheets accommodated in the sheet cassette, wherein the sheet cassette includes a first guide member for regulating the positions of the accommodated sheets in a width direction; and a second guide member for regulating the positions of the accommodated sheets in the width direction on a rear edge side, and wherein the second guide member is swingably disposed, has a plurality of regulating surfaces for carrying out regulation in correspondence to the sheets of the different types.

DESCRIPTION OF THE PREFERRED EMBODIMENTS

Preferable embodiments of the present invention will be described below exemplarily in detail with reference to the drawings.

First Embodiment

A laser beam printer (hereinafter, simply referred to as a printer) as an image forming apparatus having a sheet cassette according to a first embodiment will be specifically explained as an example. Note that, in the following explanation, first, a schematic arrangement of the printer will be explained, and then the sheet cassette will be explained in detail.

Figure 8:
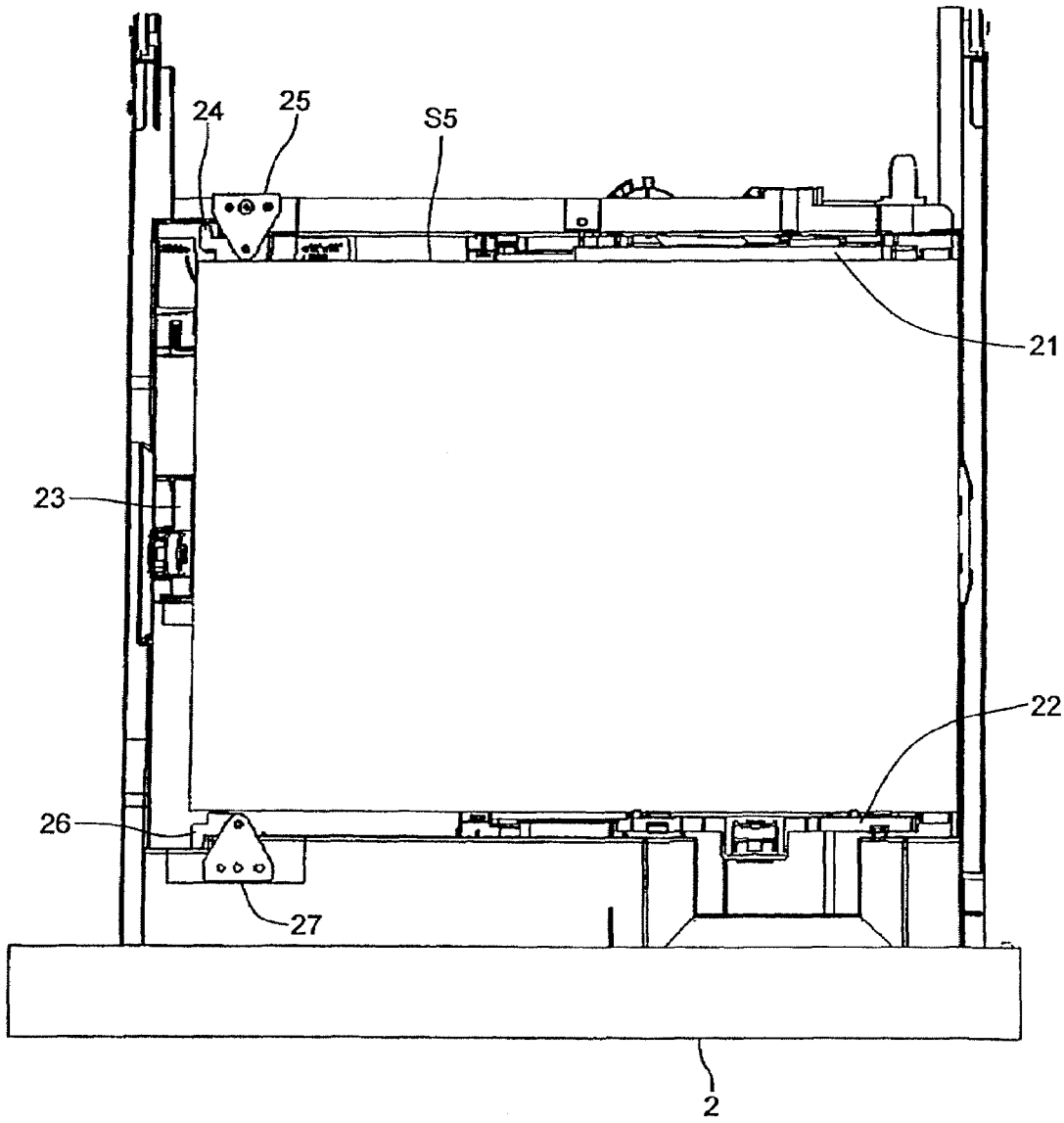
FIG. 8 is an upper view of the sheet cassette according to the second embodiment.

First, the schematic arrangement of the printer will be explained using FIGS. 8, 9A and 9B. FIG. 8 is a perspective view of the printer, and FIGS. 9A and 9B are schematic sectional views of the printer.

Figure 9A:
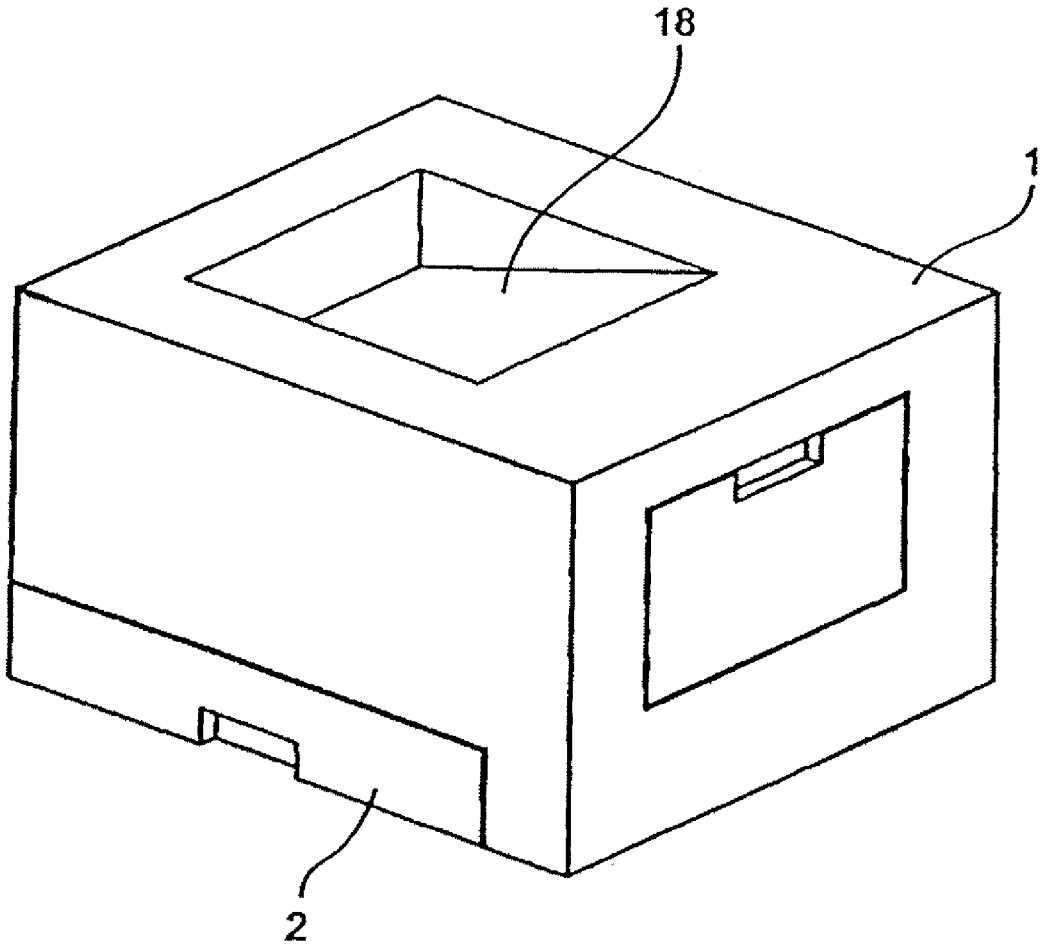
FIGS. 9A and 9B are perspective views of a printer.
Figure 9B:
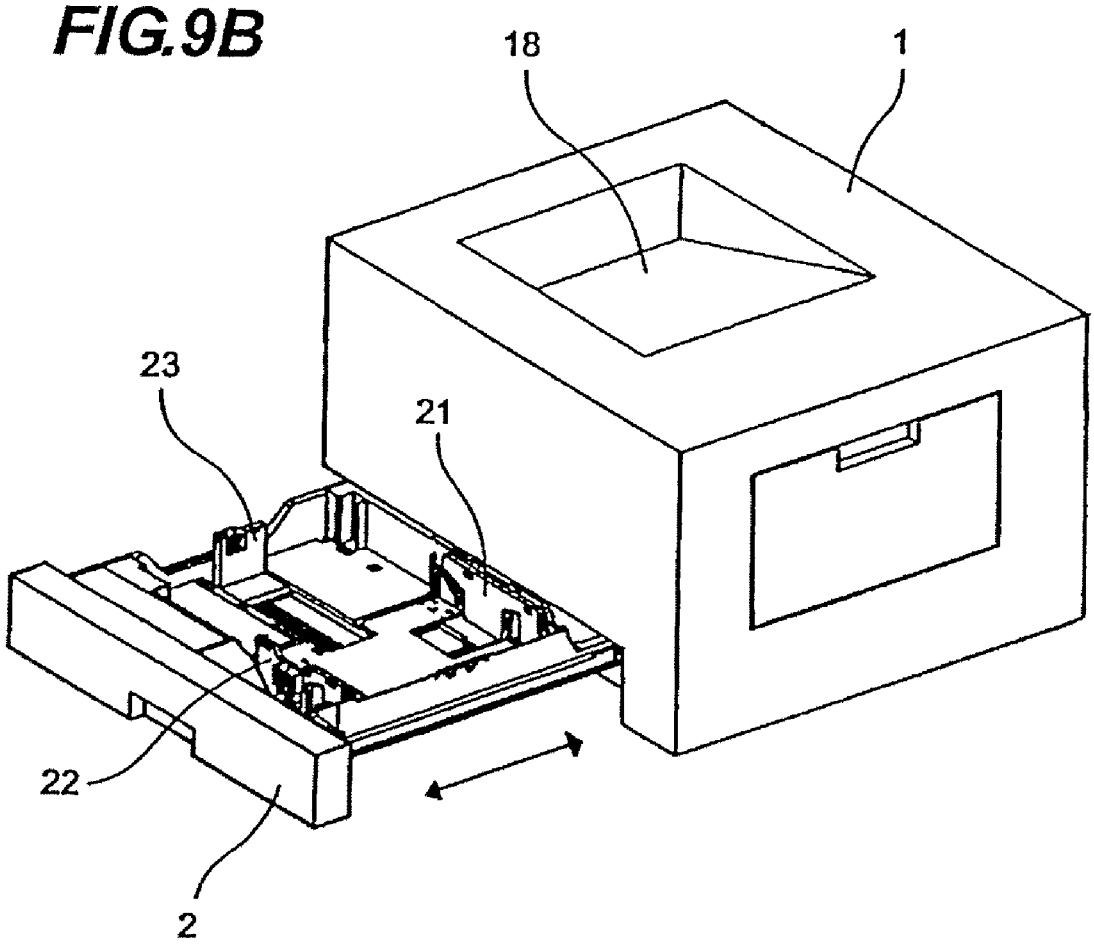
Figure 10:
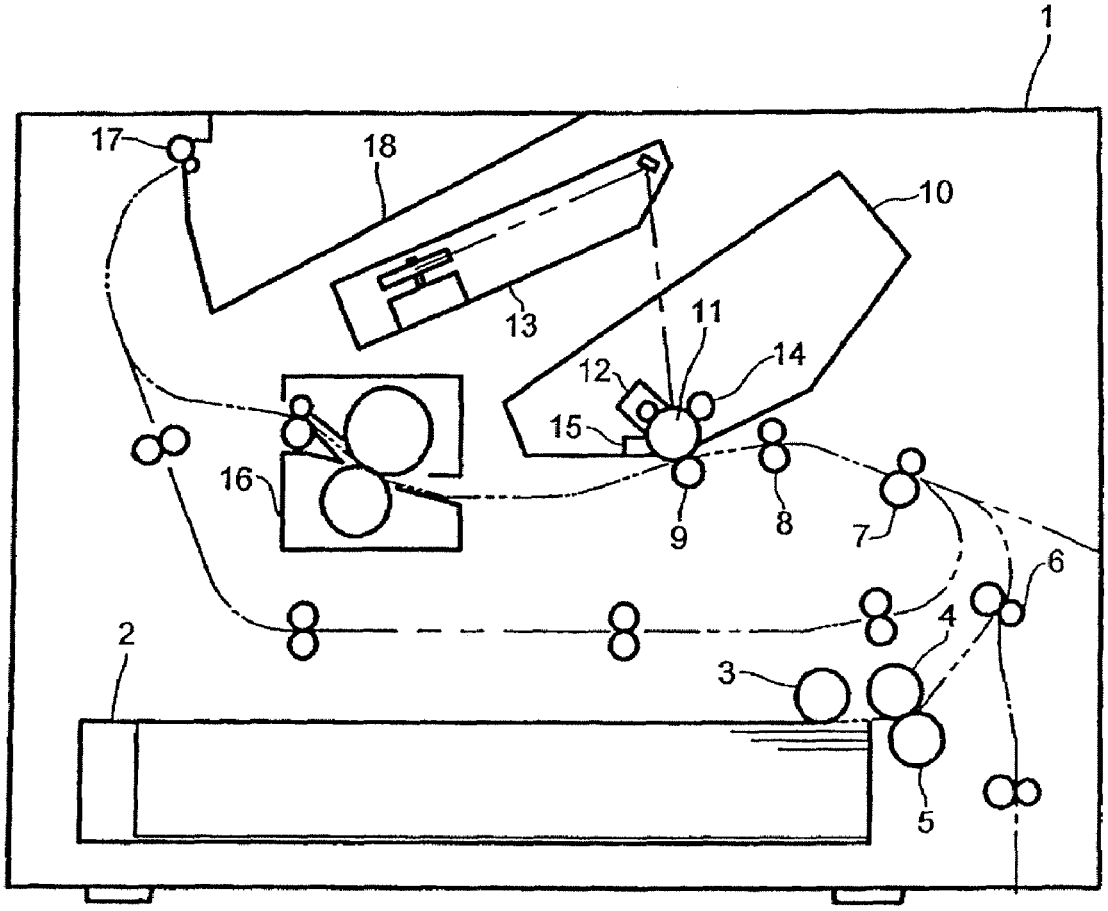
FIG. 10 is a schematic sectional view of the printer.
Figure 11:
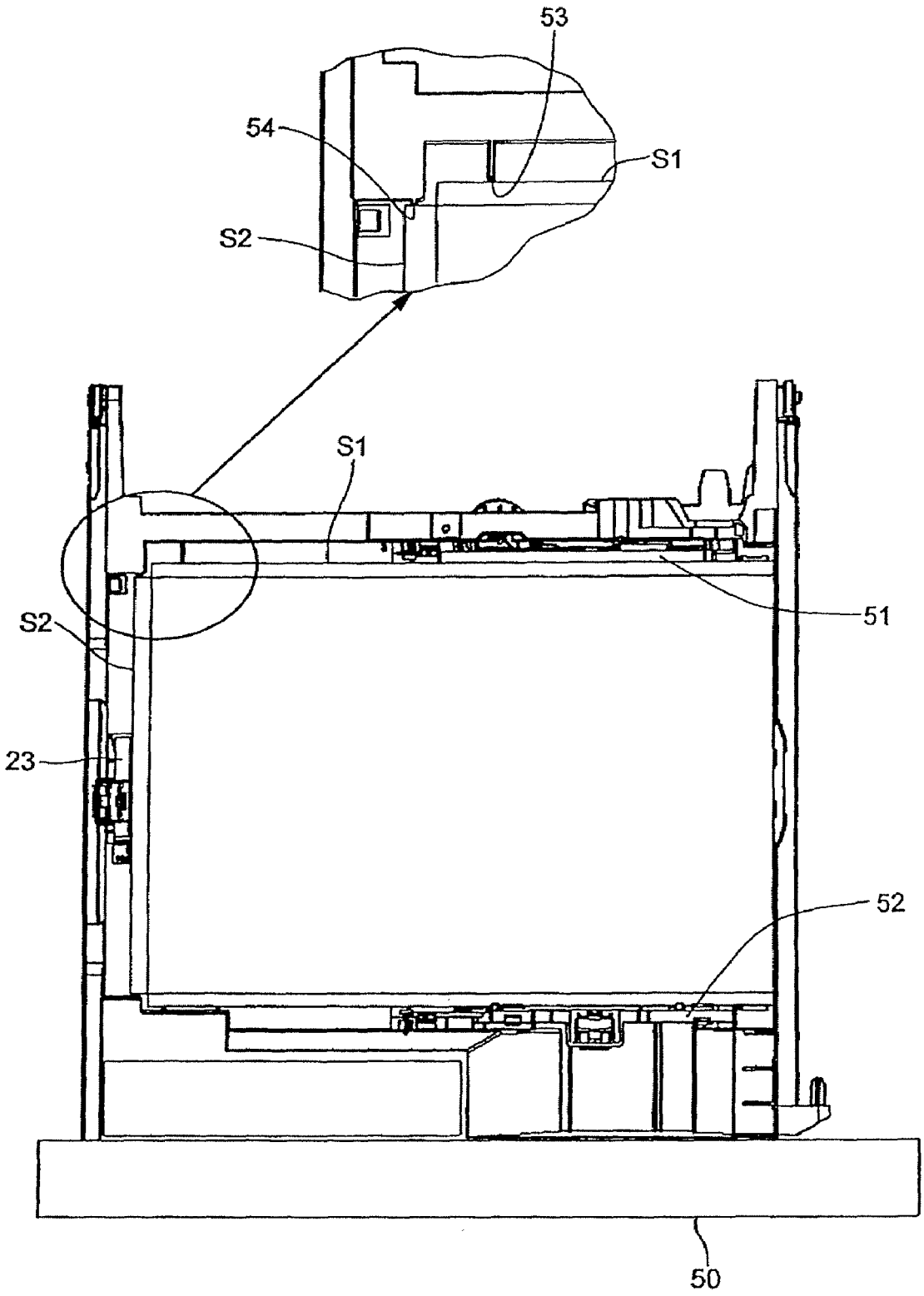
FIG. 11 is an upper view of a conventional sheet cassette.

In FIGS. 8, 9A and 9B, reference numeral 1 denotes a printer body, and a sheet cassette 2, in which sheets S are placed and accommodated, is mounted to a lower portion thereof in detachably attachable manner. The sheet cassette 2 is arranged such that it can be drawn out in a width direction orthogonal to a sheet conveyance direction with respect to the printer body. Further, the sheet cassette 2 is arranged to accommodate sheets of at least two different sizes. The sheet cassette 2 will be explained later in detail.

The sheets accommodated in the sheet cassette 2 are separated one by one and fed by rollers 3, 4, 5 constituting a sheet feeding portion. The roller 3 is a pick-up roller and feeds the sheets S placed in the sheet cassette 2 from the uppermost side thereof. The roller 4 is a feed roller and the roller 5 is a retard roller, and they separate the sheets fed by the pick-up roller 3 one by one and then feed them. A sheet feeding device is composed of the sheet cassette 2 and the sheet feeding portion.

The sheets, which are separated and fed by the feed roller 4 and the retard roller 5, are conveyed to a registration roller pair 8 by conveyance roller pairs 6, 7. The registration roller pair 8 causes the extreme edge of a sheet conveyed from the conveyance roller pair 7 to come into contact with the nip portion of the registration roller pair 8 in a state that the registration roller pair 8 stops temporarily and forms a loop of the sheet to thereby correct skew feeding of the sheet. The sheet whose skew feeding is corrected is conveyed to the edge portion between a photosensitive drum 11 in a process cartridge 10, which constitutes an image forming portion, and a transfer roller 9 confronting with the photosensitive drum 11 by the registration roller pair 8 at a predetermined timing.

The process cartridge 10 includes known process means (a charging means 12, a development means 14, a cleaning means 15) integrally therewith in addition to the photosensitive drum 11 and is disposed on the printer body 1 in detachably attachable manner. Reference numeral 13 denotes a laser exposure optical system which forms an electrostatic latent image by irradiating a laser beam according to image information on the uniformly charged surface of the photosensitive drum 11. A toner is applied onto the photosensitive drum 11, on which the electrostatic latent image is formed, by the development means 14 in the process cartridge 10, thereby a toner image is formed.

Then, the toner image formed on the photosensitive drum 11 is transferred onto the sheet conveyed to the nip portion between the photosensitive drum 11 and the transfer roller 9 by the registration roller pair 8 by the action of the transfer roller 9 in synchronism with the rotation of the photosensitive drum 11.

The sheet, onto which the toner image is transferred, is subjected to heating/pressurizing processing when it passes through a fixing device 16, thereby the toner image is permanently fixed. The sheet onto which the toner image is fixed is discharged onto a discharge tray 18 formed on the upper surface of the printer body 1 by a discharge roller pair 17.

Figure 1:
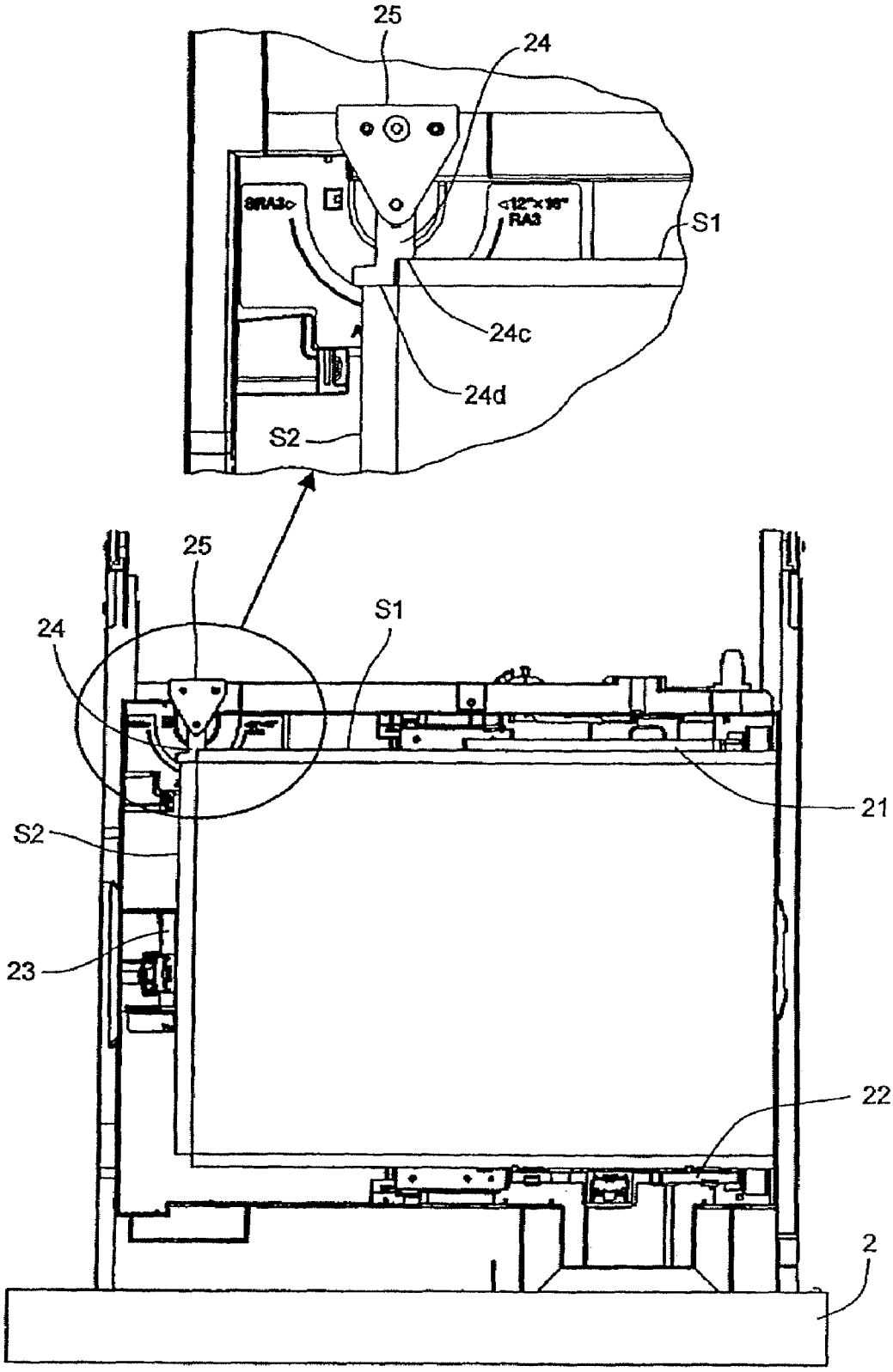
FIG. 1 is an upper view of a sheet cassette according to a first embodiment.
Figure 2:
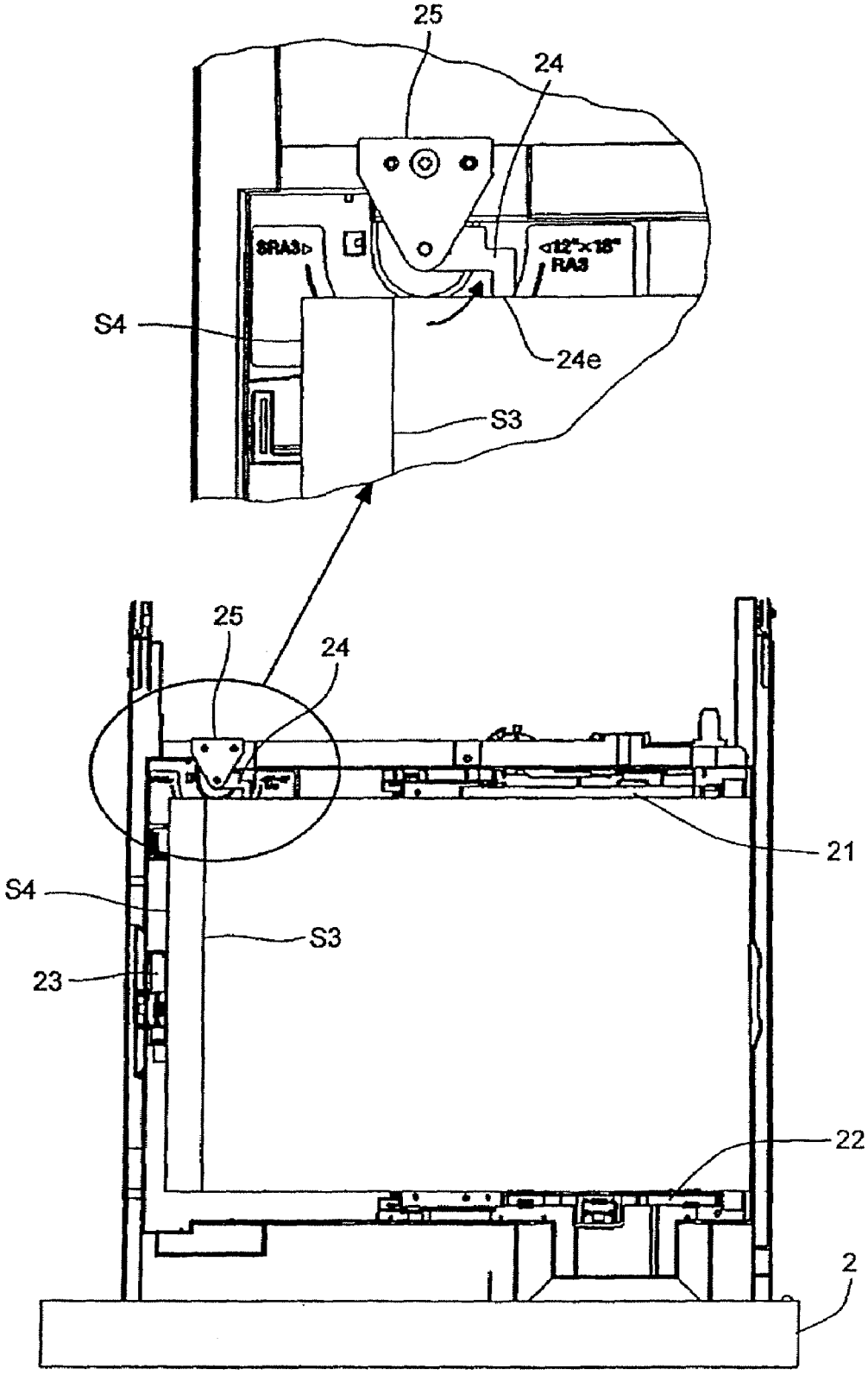
FIG. 2 is an upper view of the sheet cassette according to the first embodiment.
Figure 3:
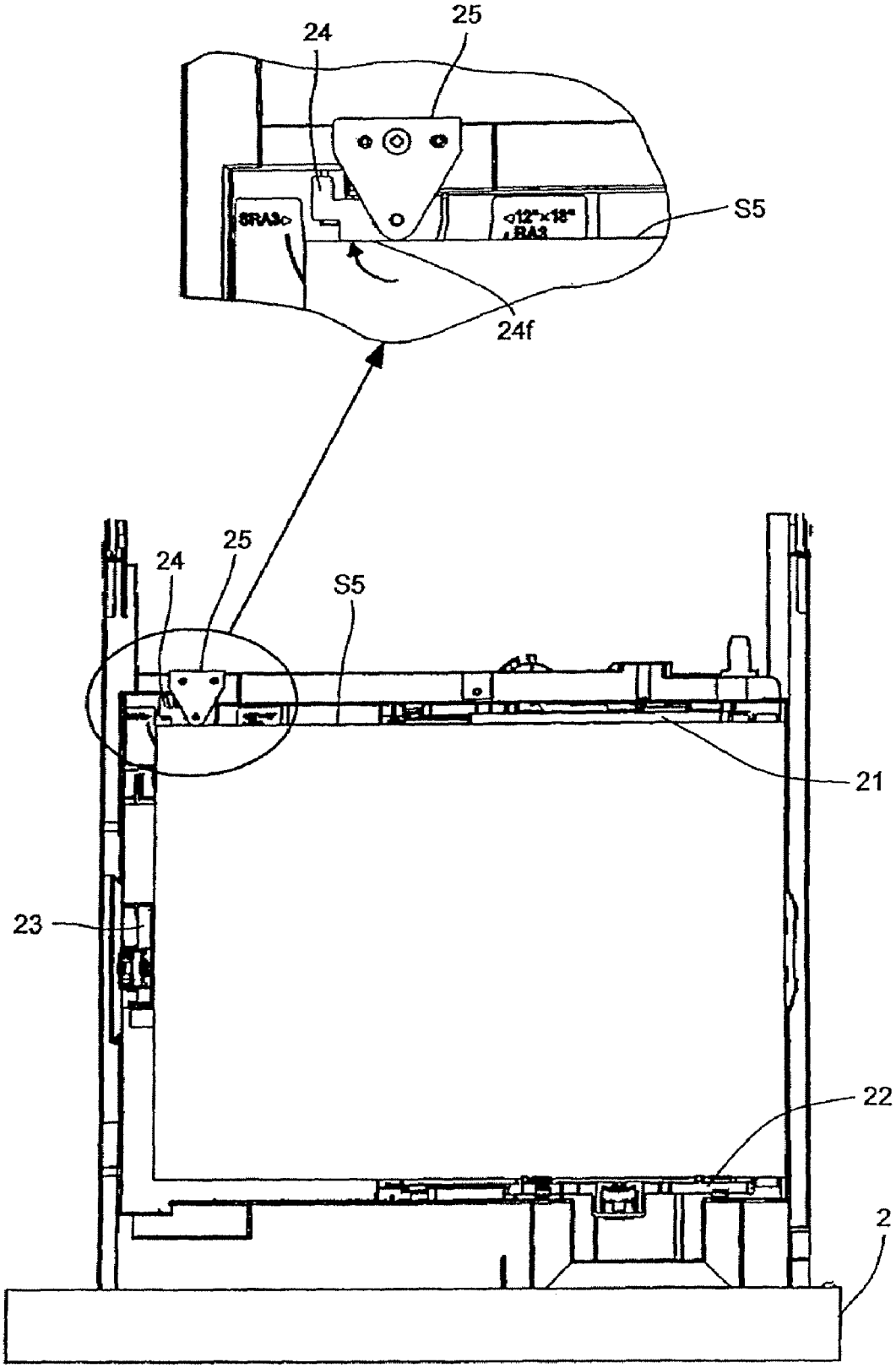
FIG. 3 is an upper view of the sheet cassette according to the first embodiment.
Figure 4:
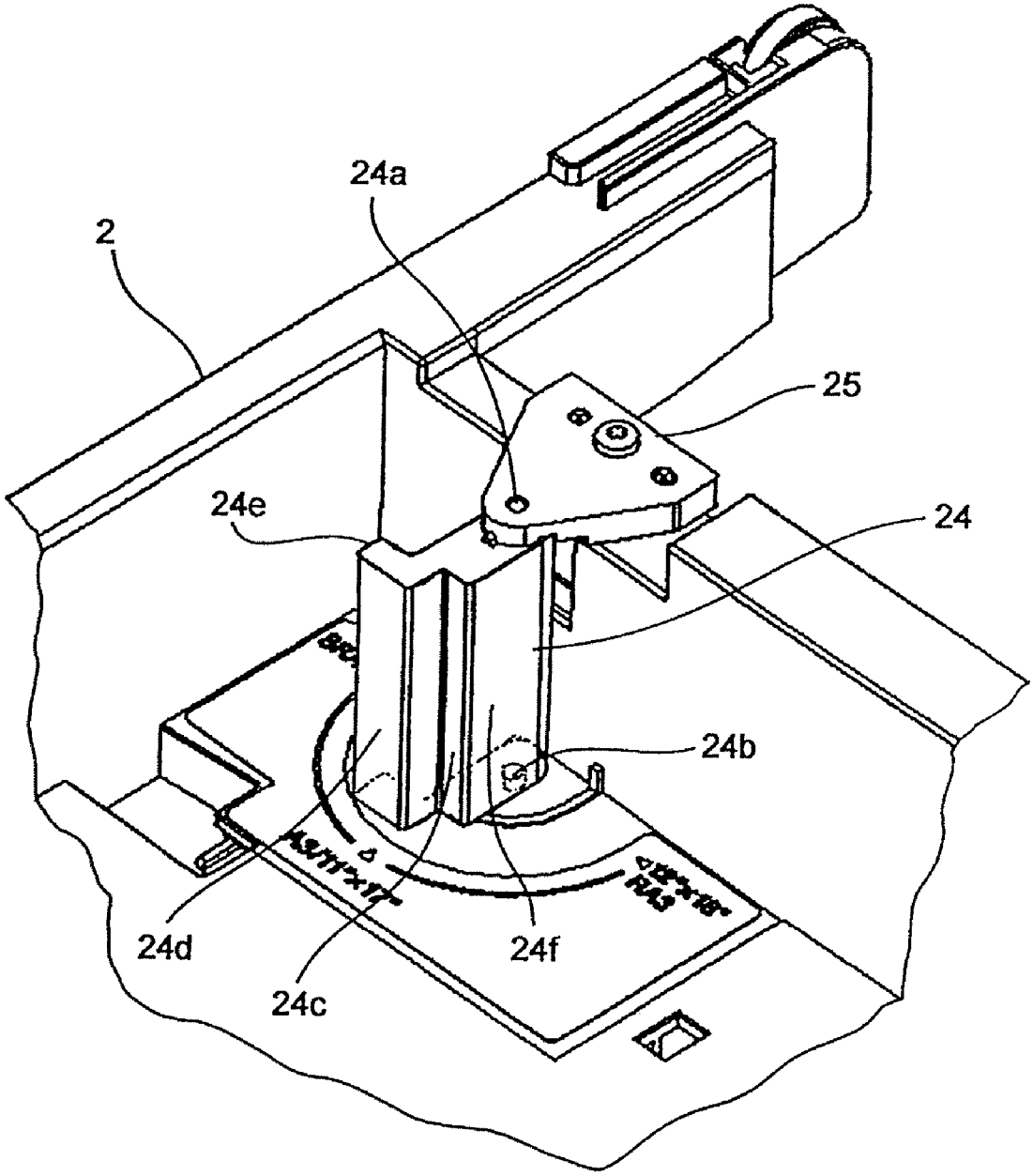
FIG. 4 is an enlarged perspective view of a rear regulation guide in the sheet cassette.

Next, the sheet cassette 2 will be explained in detail using FIGS. 1 to 5. FIGS. 1 to 3 are upper views of the sheet cassette, and FIGS. 4 and 5 are enlarged perspective views of a rear regulation guide in the sheet cassette.

The sheet cassette 2 has a pair of side guides (first guide members) 21, 22 for regulating the positions of the sheets S accommodated in the cassette in a width direction. The side guides 21, 22 are coupled with each other by a rack and pinion (not shown), and when one side guide is actuated, the other side guide is also moved in the sheet width direction in association therewith. That is, the side guides 21, 22 of the example regulate the positions of the sheets S in the width direction with respect to the center of the sheets S in the width direction as a reference.

Further, the sheet cassette 2 has a back guide 23 to regulate the rear edges of the sheets S in a conveyance direction. The back guide 23 can independently move in the sheet conveyance direction.

The sheet cassette 2 has the rear regulation guide (second guide member) 24 for regulating the positions of the sheets S in the vicinity of the rear edges thereof on a back side of the sheet cassette 2 in a mounting direction. The rear regulation guide 24 is swingably disposed so that a regulating surface can be swingably moved to a plurality of regulating positions corresponding to the sizes of different sheets. The arrangement of the rear regulation guide 24 will be described later in detail.

The upper portion and the lower portion of the rear regulation guide 24 in a sheet loading direction is swingably supported by the sheet cassette 2. As shown in FIG. 4, in the rear regulation guide 24 of the example, the lower portion 24*b* of the rear regulation guide 24 is swingably supported by the sheet cassette 2, and the upper portion 24*a* thereof is swingably supported by a holding member 25 attached to the cassette 2.

The rear regulation guide 24 can be swung to three regulating positions for regulating sheets having different sizes. As shown in FIG. 1, a first regulating position is a position corresponding to sheets having two different sizes S1, S2 (in the example, A3 size sheet S1 and 11×17 inch size sheet S2). As shown in FIG. 2, a second regulating position is a position corresponding to sheets having two different sizes S3, S4 (in the example, RA3 size sheet S3 and 12×18 inch size sheet S4) which are wider than the sheet sizes at the first regulating position. As shown in FIG. 3, a third regulating position is a position corresponding to a sheet having one size S5 (in the example, SRA3 size sheet S5) which is wider than the sheet sizes at the second regulating position.

Figure 5A:
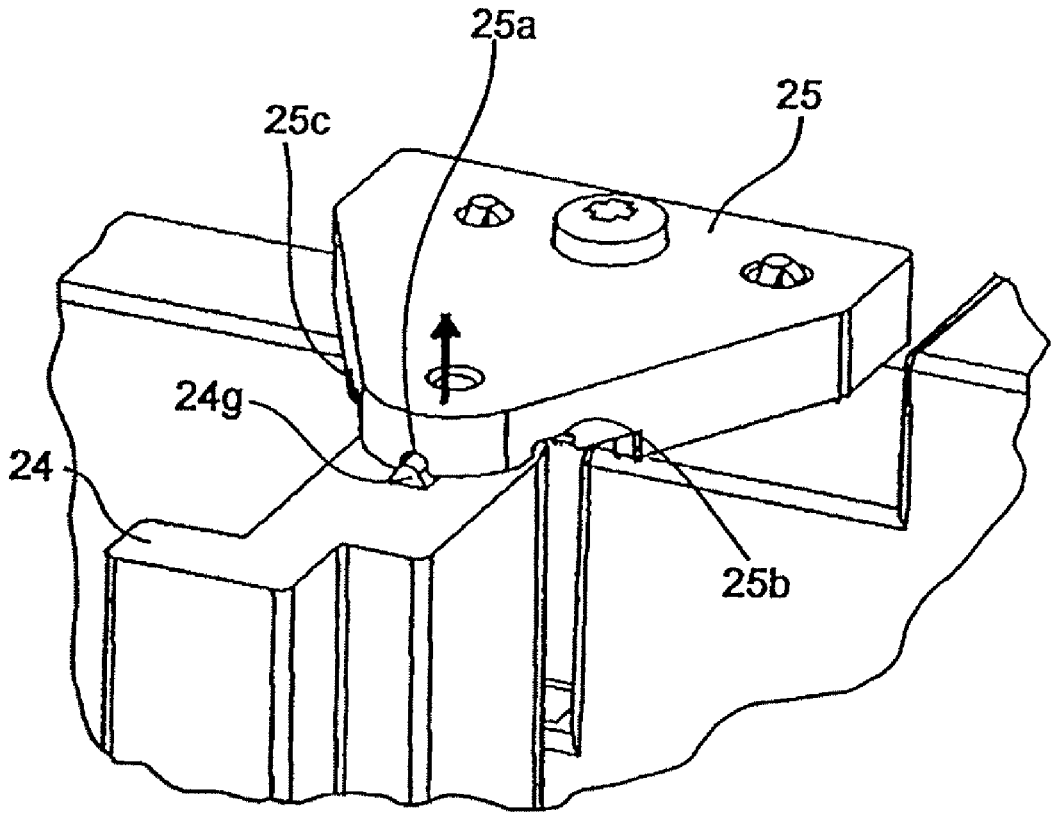
FIGS. 5A and 5B are perspective views explaining an arrangement for holding a second guide member.
Figure 5B:
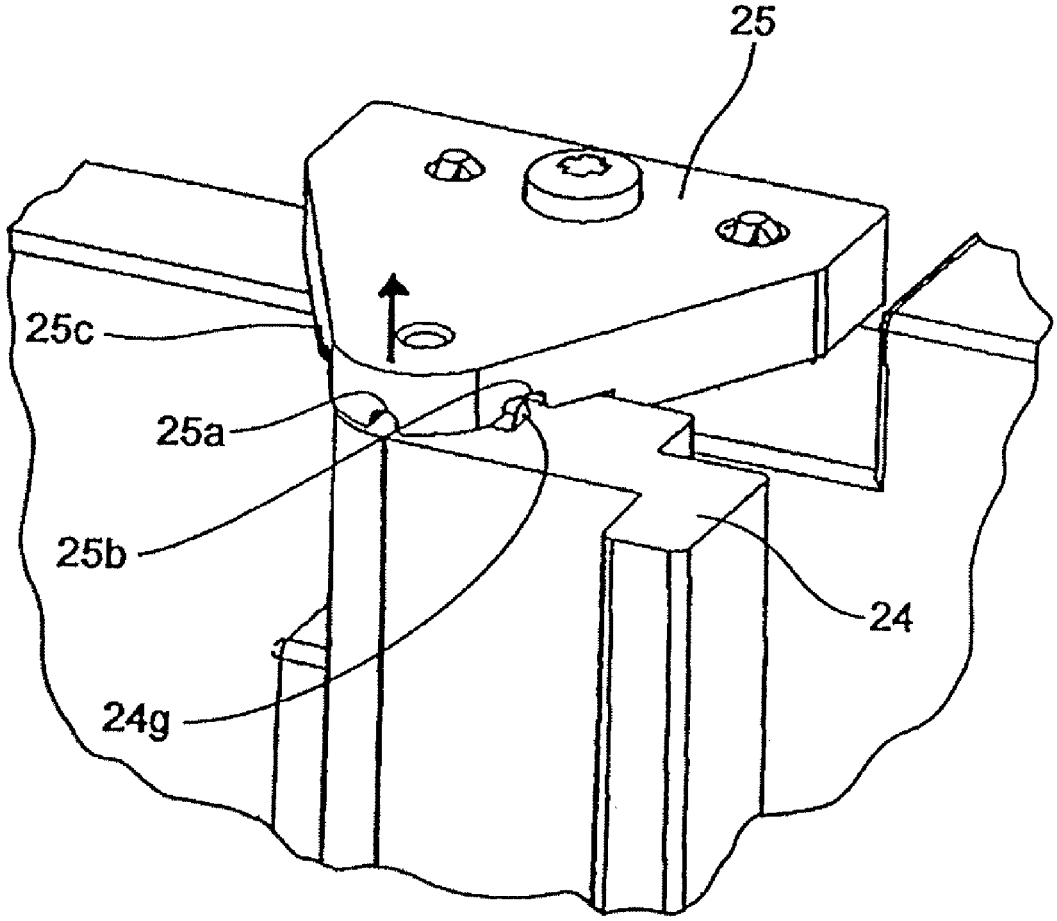

As shown in FIG. 5A described later, the rear regulation guide 24 is held in such an arrangement that a projection 24*g* disposed on the upper surface of the rear regulation guide is selectively engaged with recesses 25*a*, 25*b*, and 25*c* corresponding to the above-mentioned three regulating positions formed to the holding member 25. Then, the rear regulation guide 24 can be rotated by flexing the holding member 25 upward as shown in FIG. 5B. Note that it is preferable that the holding force of the rear regulation guide 24 generated by the position holding means is such a degree that it can prevent the rotation of a sheet caused by a shock when the cassette is inserted as well as it can release the rear regulation guide 24 being held when a regulating position is switched.

When the A3 size sheet S1 or the 11×17 inch size sheet S2 is used, the rear regulation guide 31 is swung to the first regulating position shown in FIG. 1. The rear regulation guide 31 is formed to a stepwise shape by making use of the difference of the widths and the lengths of the A3 size sheet S1 and the 11×17 inch size sheet S2 and has two regulating surfaces 24*c*, 24*d* for regulating the respective sheets S1, S2. Accordingly, when the A3 size sheets S1 are accommodated in the sheet cassette 2, they are regulated by the regulating surface 24*c*, and when the 11×17 inch size sheets S2 are accommodated therein, they are regulated by the regulating surface 24*d*. Accordingly, the two types of the sheets, that is, the A3 sheet and the 11×17 inch sheet can be regulated at the first regulating position of the rear regulation guide 24.

When the RA3 size sheet S3 or the 12×18 inch sheet S4 is used, the rear regulation guide 24 is rotated by 90° counterclockwise from the first regulating position and moved to the second regulating position shown in FIG. 2. Note that since the RA3 sheet and the 12×18 inch sheet has approximately the same width, the rear regulation guide 24 has one regulating surface at the second regulating position (a regulating surface 24*e* in FIG. 4). Accordingly, when the RA3 size sheets S3 or the 12×18 inch size sheets S4 are accommodated in the sheet cassette 2, they are regulated by the regulating surface 24*e*.

When the RA3 size sheet is used, the rear regulation guide 24 is rotated by 90° clockwise from the first regulating position and moved to a third regulating position shown in FIG. 3. Note that, in the example, since the one size of the sheet is regulated at the third regulating position, the rear regulation guide 24 has one regulating surface of the rear regulation guide 24 at the third regulating position (a regulating surface 24*f* of FIG. 4). Accordingly, when the SRA3 size sheets S5 are accommodated in the sheet cassette 2, they are regulated by the regulating surface 24*f*.

As described above, when the sheet cassette 2 is inserted, the rotate of the sheets of all the sizes which can be accommodated can be prevented by providing the rear regulation guide 24 which can be swung to the plurality of regulating positions corresponding to the sheets having the different sizes. More specifically, in the example, the sheets of all the sizes which can be accommodated in the sheet cassette 2, that is, the sheets having the sizes of A3, RA3, SRA3, 11×17 inch, 12×18 inch can be prevented from being rotated by a shock when the sheet cassette 2 is inserted into the printer body 1. As described above, when a user loads sheets in the sheet cassette 2, since the user can load the sheets in parallel with a sheet feeding direction, they can be prevented from skew feeding, thereby occurrence of jam and an image can be prevented from being deteriorated.

Second Embodiment

Figure 6:
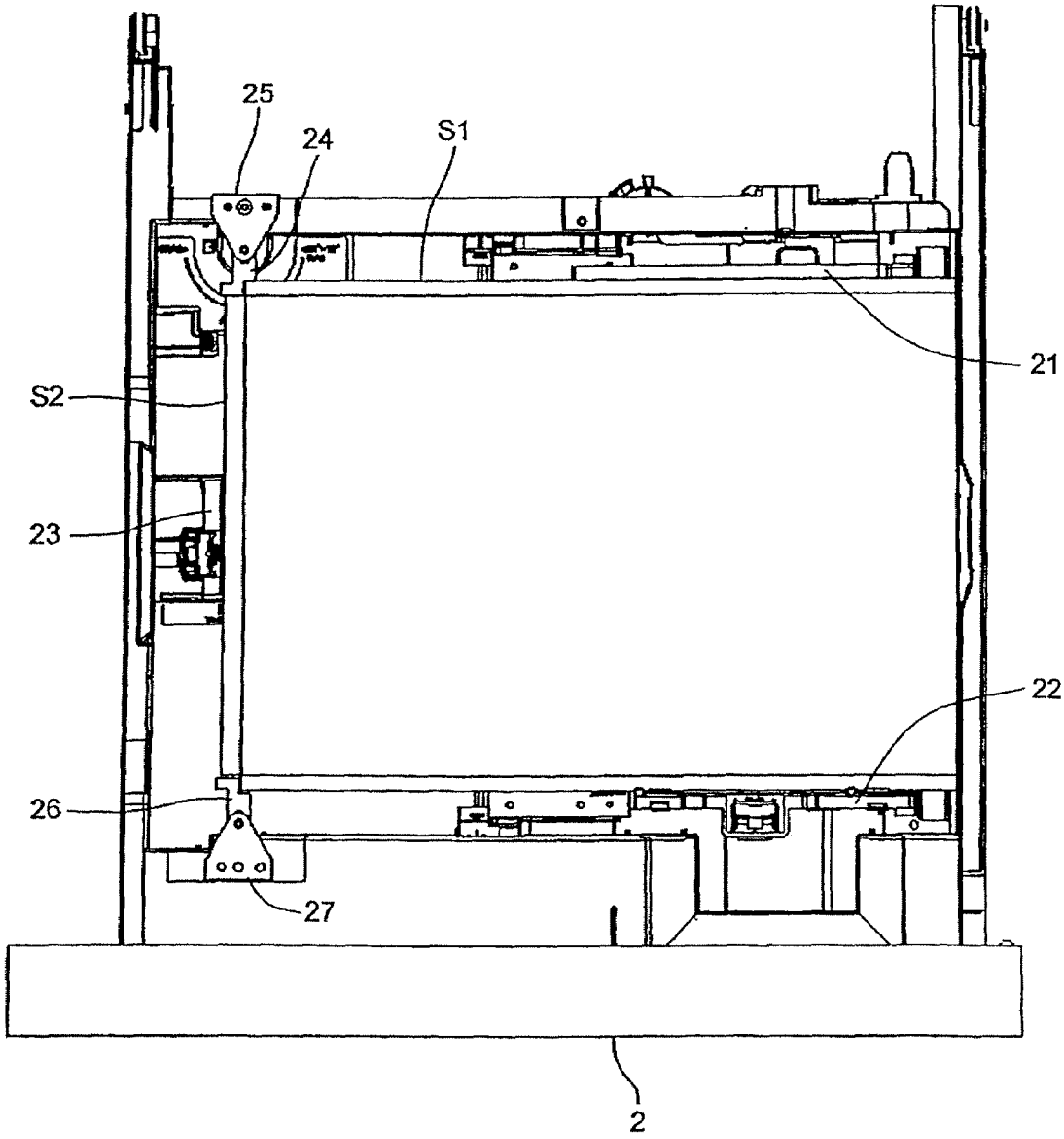
FIG. 6 is an upper view of a sheet cassette according to a second embodiment.
Figure 7:
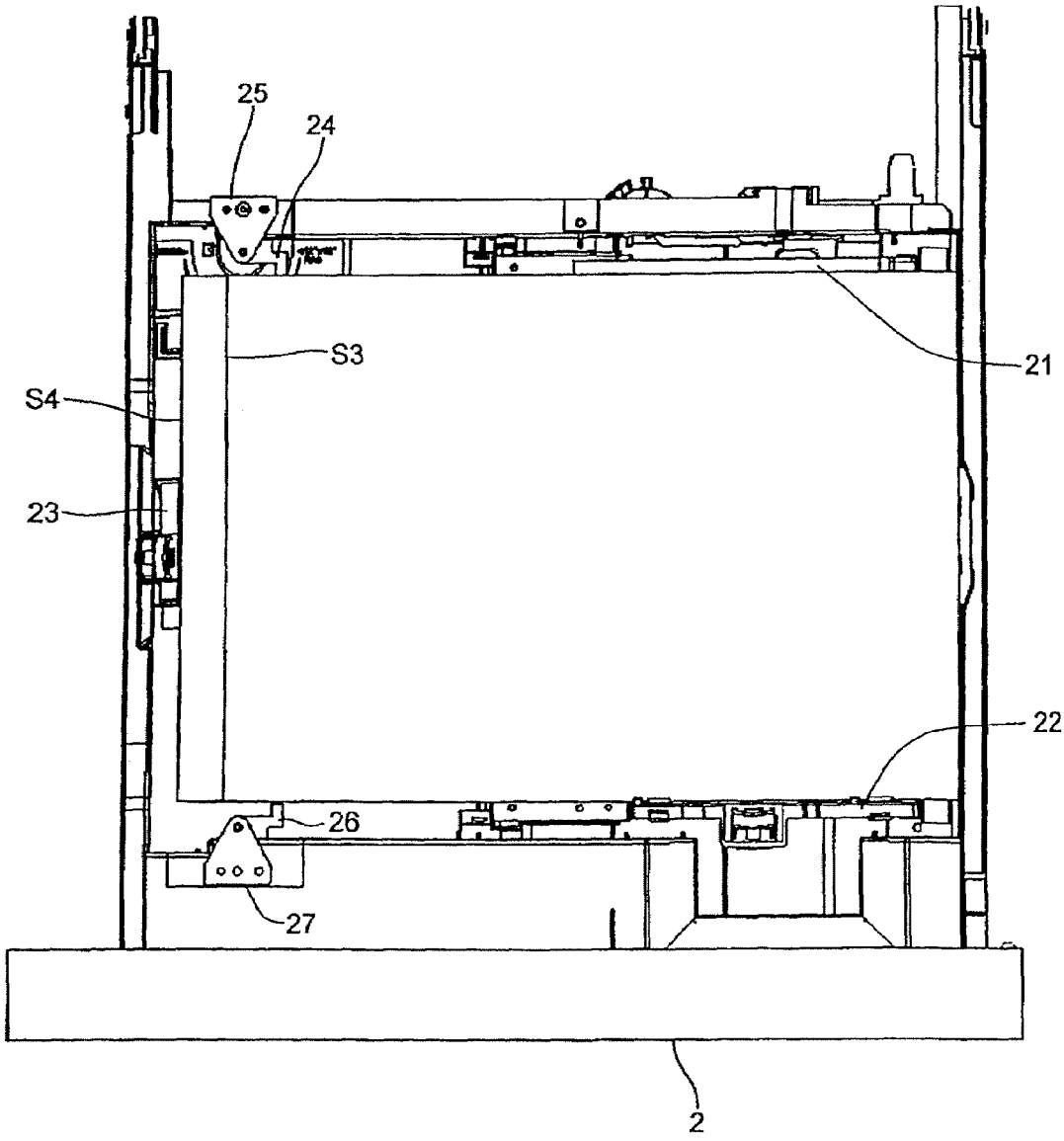
FIG. 7 is an upper view of the sheet cassette according to the second embodiment.

A sheet cassette according to a second embodiment will be explained using FIGS. 6 to 8. FIGS. 6 to 8 are upper views of a sheet cassette.

The sheet cassette 2 according to the embodiment has a rear edge front guide (third guide member) 26 for regulating the edge of a sheet in a width direction in the vicinity of the rear edge of the sheet on a proximal side of the cassette 2 in a mounting direction, in addition to the arrangement described above. The rear edge front guide 26 is disposed at a position confronting with the rear regulation guide 24 as described above in the sheet width direction. Further, the rear edge front guide 26 has right-left symmetrical arrangement to and is disposed right-left symmetrical to the rear regulation guide 24 with respect to a center in the sheet width direction as a reference. Further, the rear edge front guide 26 can be swung to regulating positions that correspond to at least two different sheet sizes likewise the rear regulation guide 24.

Arrangements for holding the rear edge front guide 26 by the sheet cassette 2 and swinging it to the regulating positions that correspond to the different sheet sizes are the same as those of the rear regulation guide 24 described above. Accordingly, the detailed explanation of them is not described here by referring to the above explanation as to the rear regulation guide 24.

Note that since the rear edge front guide 26 is in a symmetrical relation to the rear regulation guide 24, it is swung in a direction opposite to the rear regulation guide 24 with respect to the respective sheet sizes. A position shown in FIG. 6 is a first regulating position corresponding to sheets S1, S2 of two different sizes (in the example, A3 and 11×17 inch). A position shown in FIG. 7 is a second regulating position for sheets S3, S4 of two different sizes (in the example, RA3 and 12×18 inch) having a width larger the sheet sizes at the first regulating position. A position shown in FIG. 8 is a third regulating position for regulating a sheet S5 of one size (in the example, SRA3) which has a width larger than the second regulating position.

As described above, the same advantage as the embodiment described above can be obtained by providing the rear edge front guide 26 that can be swung to the plurality of regulating positions corresponding to the different sheet sizes.

Other Embodiments

Although the embodiments described above exemplify the arrangement in which the first guide member for regulating the position of the sheet in the sheet width direction with respect to the center of the sheet in the sheet width direction as the reference, the present invention is by no means limited thereto. For example, a sheet cassette may have a first guide member that can be moved to one side of a sheet in a width direction with respect to the other side of the sheet in the width direction (cassette inside wall and the like) as a reference. In this case, the one side in the width direction is a back side in a cassette drawing out direction. The same advantage can be also obtained by applying the present invention to the sheet cassette arranged as described above.

Further, the embodiments described above exemplify the arrangement that the rear regulation guide 24 and the rear edge front guide 26 can regulate one sheet size or two different sheet sizes at the respective regulating positions corresponding to the different sheet sizes. However, the number of sheet sizes that can be regulated at the respective regulating positions by the rear regulation guide 24 and the rear edge front guide 26 is not limited to the number described above and may be appropriately set as necessary. Further, the regulating positions to which the rear regulation guide 24 and the rear edge front guide 26 can be swung are not limited to the above-mentioned three positions and may be appropriately set as necessary.

Further, although the embodiments described above exemplify the printer as the image forming apparatus, the present invention is not limited thereto, and the image forming apparatus may be other image forming apparatuses such as a copying machine, a facsimile, and the like. Otherwise, the image forming apparatus may be other image forming apparatuses such as a composite machine that combines these functions, and the like. The same advantage can be obtained by applying the present invention to a sheet cassette mounted on these image forming apparatuses in detachably attachable manner.

Further, although the embodiments described above exemplify the detachably attachable sheet cassette to the image forming apparatus, the present invention is by no means limited thereto. The sheet cassette may be, for example, a sheet feeding device such as a feed deck and the like as an optional unit detachably attachable to the image forming apparatus. That is, the same advantage can be obtained by applying the present invention to a sheet feeding device, on which a sheet cassette can be detachably attachable and which has a sheet feeding portion for feeding sheets from the cassette regardless that the sheet feeding device has any arrangement.

CROSS-REFERENCE TO RELATED APPLICATION

This application claims the benefit of priority from the prior Japanese Patent Application No. 2005-279651 filed on Sep. 27, 2005 the entire contents of which are incorporated by reference herein.

What is claimed is:

1. A sheet feeding device comprising a sheet cassette which can accommodate sheets of different sizes and can be detachably attachable to a device body and a sheet feeding portion which feeds the sheets accommodated in the sheet cassette, wherein the sheet cassette comprises:

a first guide member which regulates the positions of the accommodated sheets in a width direction; and a second guide member which regulates the positions of the accommodated sheets in the width direction on a rear edge side, and wherein an upper portion and a lower portion of the second guide member are swingably supported by the sheet cassette so that the second guide member is swingably disposed on the cassette, and the second guide member has a plurality of regulating surfaces for carrying out regulation in correspondence to sheets of different types.

2. A sheet feeding device according to claim 1, wherein the second guide member can be swung to a first regulating position corresponding to at least one sheet size and to a second regulating position corresponding to at least one sheet size wider than sheet size at the first regulating position.

3. A sheet feeding device according to claim 2, wherein the second guide member can be swung to a third regulating position corresponding to at least one sheet size wider than the sheet size at the second regulating position.

4. A sheet feeding device according to claim 1, wherein the sheet cassette comprises a third guide member for regulating the position of the edge of the sheet in the width direction on a side opposite to the second guide member across the sheet, and the third guide member is arranged right-to left symmetrical to the second guide member with respect to the center of the sheet in the width direction.

5. A sheet feeding device according to claim 1, wherein the sheet cassette is detachably attachable to the device body along the width direction orthogonal to a sheet feeding direction, and the second guide member is disposed to the rear edge side of the sheets accommodated on the back side of the sheet cassette in the mounting direction.

6. An image forming device comprising a sheet cassette which can accommodate sheets of different sizes and can be mounted on a device body in detachable attachable manner, a sheet feeding portion which feeds the sheets accommodated in the sheet cassette, and an image forming portion which forms an image on a sheet fed from the sheet feeding portion, wherein the sheet cassette comprises:

a first guide member which regulates the positions of the accommodated sheets in a width direction; and a second guide member which regulates the positions of the accommodated sheets in the width direction on a rear edge side, and wherein an upper portion and a lower portion of the second guide member are swingably supported by the sheet cassette so that the second guide member is swingably disposed on the cassette, and the second guide member has a plurality of regulating surfaces for carrying out regulation in correspondence to sheets of different types.

7. An image forming device according to claim 6, wherein the second guide member can be swung to a first regulating position corresponding to at least one sheet size and to a second regulating position corresponding to at least one sheet size wider than sheet size at the first regulating position.

8. An image forming device according to claim 7, wherein the second guide member can be swung to a third regulating position corresponding to at least one sheet size wider than the sheet size at the second regulating position.

9. An image forming device according to claim 6, wherein the sheet cassette comprises a third guide member for regulating the position of the edge of the sheet in the width direction on a side opposite to the second guide member across the sheet, and the third guide member is arranged right-to left symmetrical to the second guide member with respect to the center of the sheet in the width direction.

10. An image forming device according to claim 6, wherein the sheet cassette is detachably attachable to the device body along the width direction orthogonal to a sheet feeding direction, and the second guide member is disposed to the rear edge side of the sheets accommodated on the back side of the sheet cassette in the mounting direction.

* * * * *